United States Patent [19]

Lundgren

[11] 4,069,045

[45] Jan. 17, 1978

[54] METAL POWDER SUITED FOR POWDER METALLURGICAL PURPOSES, AND A PROCESS FOR MANUFACTURING THE METAL POWDER

[75] Inventor: Bengt G. S. Lundgren, Ulricehamn, Sweden

[73] Assignee: SKF Nova AB, Gathenburg, Sweden

[21] Appl. No.: 686,937

[22] Filed: May 17, 1976

Related U.S. Application Data

[63] Continuation-in-part of Ser. No. 634,343, Nov. 24, 1975, abandoned.

[30] Foreign Application Priority Data

Nov. 26, 1974 Sweden ..... 7414811

[51] Int. Cl.[2] ..... B22D 23/08

[52] U.S. Cl. ..... 75/251; 75/.5 C; 264/8

[58] Field of Search ..... 75/.5 B, .5 BA, .5 BB, 75/.5 BC, .5 C, 251; 264/8

[56] References Cited

U.S. PATENT DOCUMENTS 3,151,971 10/1964 Clough ..... 75/.5 B

FOREIGN PATENT DOCUMENTS 2,127,563 12/1972 Germany ..... 75/.5 B

*Primary Examiner*—W. Stallard

*Attorney, Agent, or Firm*—Daniel M. Rosen

[57] ABSTRACT

A steel powder suited for powder metallurgical purposes consists of an amorphous to compact-grained, essentially dendrite-free material with irregularly cornered particle shape. Such a steel powder may be produced by causing molten steel to form at least one discrete, relatively thin film on a relatively cold metal surface of great cooling capacity, causing the thin film to solidify extremely rapidly on the metal surface to form a brittle amorphous to compact-grained, in principle completely dendrite-free steel film, and crushing or grinding the brittle film into a powder of an irregularly cornered particle shape.

10 Claims, 3 Drawing Figures

METAL POWDER SUITED FOR POWDER METALLURGICAL PURPOSES, AND A PROCESS FOR MANUFACTURING THE METAL POWDER

CROSS REFERENCES TO RELATED APPLICATIONS

This application is a continuation in part of applicant's copending application Ser. No. 634,343, filed Nov. 24, 1975, now abandoned.

FIELD OF THE INVENTION

The present invention relates to a new type of metal powder suited for powder metallurgical purposes, and to a process for manufacturing such a metal powder.

DESCRIPTION OF THE PRIOR ART

It is already known how to manufacture metal powder for powder metallurgical purposes by finely distributing or "atomizing" molten metal, the small drops produced being made to solidify to form small granules, each one of which constitutes an ingot of the molten metal. These small granules can subsequently be charged into a container which thereafter is evacuated and sealed, after which compacting under heat is carried out in order to join together the small granules into a solid metal compact with the composition of the molten metal. This method has proved extremely valuable for the production of homogeneous materials from melts of alloys susceptible to liquation, e.g. high-alloy steel, such as high speed steels, and other high-alloy material such as stellite.

The desired atomization of molten metal into small drops is usually brought about by an inert gas, such as argon or nitrogen, being made to impinge as high speed jets upon a pouring stream, but water and steam have also been used. Both water and steam are however unsuitable for e.g. high speed steel, since they cause severe oxidation of the granules. It is also known how to atomize the pouring stream with the aid of a rotating disk and to make the small drops or ingots formed solidify through contact with the surrounding atmosphere or by being made to fall into a cooling-water or oil bath, having been first perhaps subjected to a coolant shower. British Patent Specification No. 519,624 relates to powdered or granular metallic products constituted by solidified metallic particles derived from molten metal, and it also describes a method of producing the products. The solidified metallic particles have spontaneously crystallized from a metastable undercooled state at a predetermined temperature below but close to the freezing point of the metal, said particles being of substantially uniform size and mutually uniform composition.

To produce the particles, molten metal is discharged from a suitable receptacle in one or more streams onto a metal surface of such nature that sufficient heat is abstracted from the molten metal to lower the temperature thereof to the so-called plastic range; i.e., to a point which is slightly below the freezing point of the particular metal but without causing solidification or crystallization. This surface upon which the molten metal impinges is rapidly moving either linearly as in the case of a belt or rotatively as in the case of a disk. In either event, the molten metal is immediately converted into a stream of film-like proportions on the surface and the extent of the belt or disk surface is such that the molten metal contacts therewith for a period just sufficient to undercool it as above defined. Then the molten metal is caused to leave the supporting surface and to continue its travel in the same direction and at substantially the same speed for a sufficient distance to cause solidification, but due to the fact that the undercooled stream of film-like proportions has little or no inherent strength, it immediately breaks up into a myriad of fine, small liquid particles which, when they solidify as above set forth, result in the formation of a powdered metal.

These operations may be carried out in a vacuum or suitable atmosphere, and the myriad of fine, small liquid particles may be made to pass through a coolant in order to hasten solidification of the particles or to reduce the distance through which they need be projected to effect solidication. As solidification takes place after the molten metal has left the belt or disk surface, surface tension will cause the particles to assume a substantially spherical shape, and even though the cooling rate may be comparatively high, it is not high enough to prevent a considerable formation of dendrites, as explained below.

In a successful method of producing high speed steel powder (see e.g. *Teknisk Tidskrift,* 1974:16, pp. 18–23) a pouring stream is atomized at the top of a high tower with the aid of argon jets, and the small drops formed are made to fall down through the argon-filled tower. Whilst falling, the drops solidify into mainly spherical granules with a grain size of up to about 700 $\mu$m. The tower must be sufficiently high, about 10 m, for the small spheres to have solidified sufficiently while falling not to stick together in a powder aggregate when they reach the bottom of the tower. In order to eliminate the risk of sticking together, it has been proposed that the solidified spheres should be collected in a container with liquified gas, placed at the bottom of the tower.

Granules produced by the above mentioned conventional methods have solidified considerably faster than normal large ingots, and it has been possible to achieve cooling rates of up to about $10^3$ ° C/s. The granules produced have not however been able to fulfill the high quality demands imposed upon them. On one hand they have contained dendrites, although of smaller size than those obtained during the solidification of large ingots, and on the other they have contained inert gas used during atomization and/or cooling, and dissolved and/or trapped in the molten metal. In addition, in certain production processes the surface of the granules has been affected chemically, e.g. by oxidation or decarburization. Dendrites are fast growing crystals with many branches and a tree-like structure, formed during the solidification of an ingot. Molten metal of a different composition from that in the dendrites is enclosed between the branches, which leads to inhomogeneities in the ingot.

SUMMARY OF THE INVENTION

The object of the present invention is to provide a metal powder suited for powder metallurgical purposes, which clearly meets the powder metallurgical quality demands imposed, even if extraordinarily high.

According to the present invention, the new metal powder consists of an amorphous to compact-grained, essentially dendrite-free material with irregularly cornered particle shape.

Further, according to the invention, such a metal powder can be manufactured by using on the one hand a molten metal or alloy of a composition such that rapid cooling of thin films of the melt gives relatively brittle, crushable films, and on the other hand a cooled metal surface which is relatively cold and has a great cooling capacity, causing the thin film to solidify extremely rapidly on the relatively cold metal surface of great cooling capacity to form a relatively thin, brittle, and easily crushed, amorphous to compact-grained, essentially or completely dendrite-free metal film, and crushing or grinding the formed metal film into a powder of an irregularly cornered particle shape.

The brittleness of the solidifed metal films varies with their hardness. With films of hardened steel the hardness should be at least about HRC=60 to make them brittle and easy to crush.

Depending on the degree of grinding or crushing, the particles obtained can be generally characterized as miniature flakes with a thickness which is at least one order of magnitude less than their length. Pressings made of spherical powder have very low thermal conductivity, because the individual spherical powder grains only have point contact with one another, which necessitates long heating times up to sintering or heat compacting temperatures. As opposed to this, in the metal powder according to the present invention, the individual miniature flakes will have surface contact with one another, which considerably improves the thermal conductivity of the powder pressing and shortens heating times.

By causing the molten metal to form a thin layer or film on the cold metal surface of great cooling capacity, considerably faster solidification can be achieved than by the above noted conventional methods of producing spherical metal powder from a melt. Thanks to extremely rapid solidification, an essentially dendrite-free, very fine-grained to amorphous structure is obtained, and only negligible quantities of protective gas have had time to dissolve in the melt. It is also possible to carry out solidification so rapidly that completely dendrite-free films are obtained, and by working in a vacuum the risk of absorbing protective gas into the melt can be completely eliminated. When using the process according to the invention, the cooling rate must be at least about $10^4$ ° C/s, preferably at least about $10^5$ ° C/s, and expediently at least about $10^6$ ° C/s, at least in the solidification temperature range.

The layer or layers are preferably formed by causing the molten metal to iminge upon at least one hard and relatively cold metal surface of great cooling capacity, moving rapidly and substantially across the direction of delivery of the melt.

For ordinary tool steels, the temperature of the metal surface should be maintained at a minimum of 200° C lower than the temperature at which solidification is completed.

In this way thinner films are obtained than is possible by any other known method, and the thinner films give a finer metal powder and have solidified even more rapidly. The metal films formed in this way are flake-shaped.

So that the metal films or flakes can be easily broken up into powder of the required particle size, the parameters which during manufacture determine the dimensions of the films or flakes should be so mutually adjusted that the thickness of the films or flakes is at most about 0.5 mm, preferably at most about 0.1 mm. Expediently, the parameters are also so mutually adjusted that the ratio of the foils' or flakes' length to thickness is at least 100, the ratio of their width to thickness is at least about 20, and the ratio of their length to width is at the most about 5.

DESCRIPTION OF THE PREFERRED EMBODIMENTS

Figure 1:
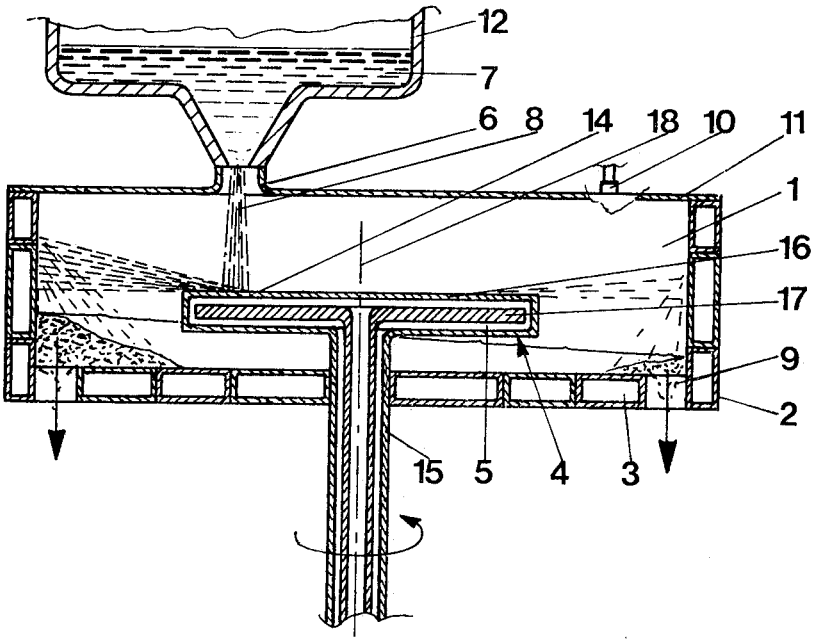
FIG. 1 is a view of a vertical cross section through a schematically illustrated embodiment of a device for manufacturing thin, brittle, easily crushed metal films or flakes.

The device shown in FIG. 1 for manufacturing metal flakes incorporates a container 1, which in the embodiment shown is cylindrical and has a casing 2 and a bottom portion 3. Both casing 2 and bottom portion 3 are water-cooled, although no details are shown as to how the water cooling itself is achieved. The container 1 also has a cover 11 with an inlet orifice 6, to which is connected a casting box 12. The casting box 12 contains molten metal 7 of such a composition that rapid cooling of thin layers of the melt produces relatively brittle, crushable films. A conduit 10 connected to the cover 11 permits the container 1 to be placed under vacuum by means of a vacuum pump which is not shown, and/or to be charged with protective gas from a suitable source which is now shown.

The molten metal 7 from the casting box 12 is made to impinge upon a hard and relatively cold metal surface 14 of great cooling capacity, moving rapidly and substantially across the direction of delivery of the molten metal, to form at least one discrete, relatively thin, flake-shaped layer of molten metal on the metal surface 14. In the embodiment of the device shown, the metal surface 14 is the upper side of an internally cooled disk 4, which is located under the inlet orifice 6 and can rotate in the container. The disk is mounted on a driving shaft 15 extending out of the container 1. The disk 4 and driving shaft 15 are provided with internal conduits 5 for passage of the cooling water, and together form a "cold finger" type of cooling unit with an external part 16 and an internal part 17, of which at least the external part 16 is rotated by a motor which is not shown.

The disk 4, which in the embodiment shown is flat, circular and arranged in the horizontal plane, has its axis of rotation 18 displaced sideways in relation to the casting or tapping stream 8 dropping from the casting box 12, so that the stream 8 impinges eccentrically upon the rotating cooled disk 4. In this way a plurality of mutually spaced, relatively thin, flake-shaped layers of molten metal are formed on the cooled metal surface 14, which thanks to the great cooling capacity of the cooled metal surface 14 are made to solidify extremely rapidly on the latter, to form relatively thin, brittle and easily crushed, essentially dendrite-free metal flakes of amorphous to compact-grained structure. The metal flakes are thrown out against the water-cooled casing wall 2, and then fed out by means of suitable devices, which are now shown, through outlet holes 9 provided in the bottom portion 3 of the container. Because the brittle flakes are not to be used as such, but constitute an intermediate product, it does not matter if the discharge devices cause some crushing of the flakes.

Thanks to the great cooling capacity of the cooled metal surface 14, solidification takes place extremely rapidly. Within an interval of time, introduced when a drop of molten metal impinges upon the cooled metal surface 14 and terminated when the drop, converted into a thin solidified flake, leaves the cooled metal surface or has at least been cooled by the metal surface 14 to a temperature below the point of sticking, the cooling rate is extremely high, i.e. at least about $10^4$ ° C/s, preferably at least about $10^5$ ° C/s, and expediently at least about $10^6$ ° C/s.

The dimensions of the flakes produced depend on a number of parameters, of which the most important are the temperature of the melt 7, the pouring rate, the height of delivery, and the velocity of the cooled metal surface 14 at the point of impact of the casting stream 8. These parameters are so mutually adjusted that the metal flakes' thickness is at most about 0.5 mm, preferably at most about 0.1 mm. In the device shown, low r.p.m. of the disk 4 produce relatively thick flakes, and higher r.p.m. thinner flakes. This can be explained by the fact that, when the molten metal impinges upon the cooled metal surface 14, it first solidifies at the interface with the cooled metal surface 14 and is pulled by this through friction into rotation around the axis 18, whereas the molten metal lying on top is thrown outwards more easily due to inertia. The solidified flakes do not cling to the cooled surface 14, but the material in its entirety is thrown outwards.

Figure 2:
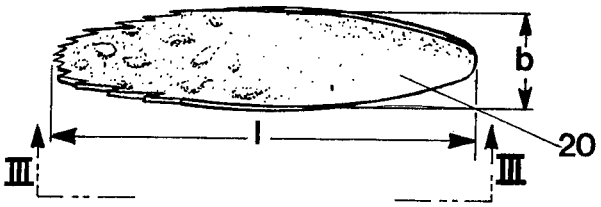
FIGS. 2 and 3 are a plan and a side view, respectively, of a metal flake produced in the device.
Figure 3:
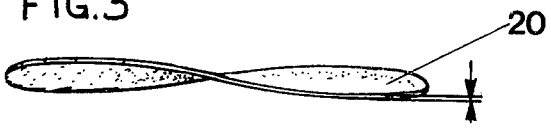

It is also expedient for the above quoted parameters to be so mutually adjusted that, as shown in FIGS. 2 and 3, the ratio of the metal flakes' 20 length "*l*" to thickness "*t*" is at least 100, the ratio of the flakes' width "*b*" to thickness "*t*" at least about 20, and the ratio of the flakes' length "*l*" to width "*b*" is at most about 5. Such flakes are easy to make, store and transport and to crush or grind into powder. The metal flakes 20 shown in FIGS. 2 and 3 are mainly oval or elliptical, and have a slight propeller-like twist about their longitudinal axis. One end of the flake has a relatively even edge, whilst the edge at its other end is relatively uneven, as a result of the solidifying process described above. FIG. 2 also shows that the surface of the metal flake 20 is relatively rough.

Since the brittleness of a flake varies with its hardness, the hardness of a flake of hardened steel should be at least about HRC=60 to make the steel flake brittle and easy to crush. For example, flakes made from SAE 52100 (1.0%C, 0.3%Mn, 1.5%Cr, balance Fe) has a hardness of HRC=60 and are brittle and easy to crush. After crushing, the resulting powder particles have a hardness in the range of HRC=70 to HRC=72 due to strain hardening.

At to the temperatures, that of the molten SAE 52100 steel 7 in casting box 12 is preferably in the range of 1600° to 1650° C, i.e. about 150° C above a temperature at which austenite starts precipitating from the molten solution. The inlet temperature of the cooling water passed through the rotating disk 4 varies between about 5° C in winter-time and 15° C in summer-time. Presuming batch-wise operation the initial temperature of the cooled metal surface 34 will, thus, be about 10° C as an average. With a casting aperture of 8 mm diameter provided in the bottom of the casting box 12, the steel flakes will be produced at a rate of slightly higher than 0.7 kg/s, and the rate of the temperature rise will initially be rather steep. It will take about 14 minutes to produce 600 kg of steel flakes, and then the temperature 0.1 mm below the surface 34 of the disk will be about 900° C. A temperature of 1000° C will be reached after about 34 minutes, but it would take about 108 minutes (extrapolated value) to reach a maximum permissible temperature of 1100° C. A normal batch of molten steel is about 3 tons and will be processed in about 70 minutes under the above conditions. Thus, the temperature differential from the molten steel varies from about 1600° C at the beginning to at least about 550° C at the end of the processing of a 3 ton batch.

To reduce the rate of the temperature rise it is possible to let the pouring stream 8 impinge upon the circular disk 4 at a greater distance from its axis 18 while simultaneously reducing the r.p.m. of the disk to keep the relative speed of the disk at the impingement point unchanged. The relative speed preferably is in the range of about 10 to about 15 m/s.

During an experiment with the device shown in FIG. 1, the molten metal 7 consisted of high speed steel at a temperature of 1600° C, the pouring stream had a diameter of about 10 mm, and the height of delivery was 500 mm. The cooled disk 4 had a diameter of 250 mm and rotated at 30 $s^{-1}$, and the pouring stream 8 impinged upon the circular disk 4 at about 70 mm from the latter's periphery. This produced mainly elliptical flakes which looked like those in FIGS. 2 and 3 and had a length "*l*" of about 70 mm, a width "*b*" of about 12 mm and a thickness "*t*" of about 0.1 mm. The flakes had solidified extremely rapidly, the cooling rate was about $10^6$ ° C/s, and the flakes were completely free of dendrites and had an amorphous structure, and due to their very high hardness they were also very brittle and very easy to crush.

Half the high speed steel flakes were ground in a ball mill into a metal powder of irregularly cornered particles (the majority of the particles could be described as micro-flakes), and the metal powder was charged into a cylindrical container and vibration compacted. The other half of the flakes were put straight into an identical container, and a weight in the form of a cylindrical disk was placed on top of the flakes, after which vibration compaction was carried out. Thereby, the flakes were crushed against each other, and the crushed material was compacted to a predetermined apparent density. Both containers were evacuated, sealed and then heated to the intended compacting temperature (about 1150° C) and transferred to a high pressure chamber, in which they were isostatically blast-compacted by the direct action on the containers of gases obtained from a low explosive introduced into the high pressure chamber. After cooling, it could be established that both the high speed steel pieces produced had throughout completely pore-free, even and extremely fine-grained structures.

A very great advantage of the process according to the invention is the possibility of working under a vacuum, which produces very low oxygen contents. In the example quoted above with high speed steel, the oxygen content amounted to only 16 ppm.

The invention is not restricted to the example illustrated and described, but can be modified in various ways within the scope of the claims below. The disk can, for example, be made bowl-shaped instead of flat, and it can be arranged at an angle to the horizontal plane. In addition, metallic cooling bodies other than rotating disks can be used, provided that they have a sufficiently low temperature and large cooling capacity, and that they move sufficiently fast substantially across the direction of delivery of the molten metal to produce exceptionally rapidly solidified metal flakes. When using a vacuum, a certain fragmentation of the pouring stream takes place even before it impinges upon the rotating cooled disk, and this fragmentation is due to the gas dissolved in the melt escaping.

What is claimed is:

1. A steel powder suited for powder metallurgical purposes, characterized in that it consists of an amorphous to compact-grained, essentially dendrite-free material with irregularly cornered particle shape.

2. A steel powder according to claim 1, characterized in that the steel has a hardness of at least HRC=60.

3. An article manufactured from powder in a powder metallurgical manner, characterized in that the powder comprises the steel powder according to claim 1.

4. A process for the production of a steel powder suited for powder metallurgical purposes, comprising the steps of (1) causing, in a vacuum or protective gas, molten steel of such composition that rapid cooling of thin films of the melt produces brittle crushable films to impinge upon a cold metal surface having great cooling capacity moving rapidly and substantially across the direction of delivery of the molten steel, thereby forming a thin, brittle, and easily crushed, amorphous to compact-grained, essentially dendrite-free steel film, and (2) crushing or grinding the steel film into a powder of an irregularly cornered particle shape.

5. A process according to claim 4, in which the molten steel cools at a rate of at least about $10^4$ ° C/s.

6. A process according to claim 5, in which the cooling rate is at least about $10^6$ ° C/s.

7. A process according to claim 4, wherein the films' thickness is at most about 0.5 mm.

8. A process according to claim 7, wherein the films' thickness is about 0.1 mm.

9. A process according to claim 7, in which flake-shaped films are produced having a ratio of length to thickness of at least 100, a ratio of width to thickness of at least about 20, and a ratio of length to width of at most about 5.

10. A process according to claim 4, in which the films produced have a hardness of at least HRC=60.

* * * * *